US008038147B2

(12) United States Patent
Ogata et al.

(10) Patent No.: US 8,038,147 B2
(45) Date of Patent: Oct. 18, 2011

(54) SHEET PROCESSING APPARATUS AND IMAGE FORMING APPARATUS INCLUDING THE SAME

(75) Inventors: Atsushi Ogata, Mishima (JP); Masayoshi Fukatsu, Suntou-gun (JP); Junichi Sekiyama, Tokyo (JP); Hiroharu Tsuji, Numazu (JP); Akihiro Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/970,254

(22) Filed: Dec. 16, 2010

(65) Prior Publication Data

US 2011/0084442 A1 Apr. 14, 2011

Related U.S. Application Data

(62) Division of application No. 12/017,792, filed on Jan. 22, 2008, now Pat. No. 7,874,558.

(30) Foreign Application Priority Data

Jan. 26, 2007 (JP) ..... 2007-015797
Jan. 18, 2008 (JP) ..... 2008-008739

(51) Int. Cl.
*B65H 31/36* (2006.01)
*B65H 33/04* (2006.01)

(52) U.S. Cl. ..... 271/221; 271/218; 271/238; 271/240; 271/207; 270/58.12; 270/58.08; 270/58.13; 270/58.11; 399/408; 399/410

(58) Field of Classification Search ..... 271/221, 271/218, 207, 238, 240; 270/58.12, 58.08, 270/58.13, 58.11; 399/408, 410
See application file for complete search history.

(56) References Cited

U.S. PATENT DOCUMENTS

| | | | |
|---|---|---|---|
| 6,142,461 | A | 11/2000 | Asao et al. |
| 6,302,606 | B1 | 10/2001 | Hayakawa et al. |
| 6,318,718 | B1 | 11/2001 | Ogata et al. |
| 6,382,614 | B1 | 5/2002 | Fukatsu et al. |
| 6,382,616 | B1 | 5/2002 | Waragai et al. |
| 6,561,503 | B1 | 5/2003 | Ogata et al. |
| 6,581,922 | B2 | 6/2003 | Kuwata et al. |
| 6,661,995 | B2 | 12/2003 | Isobe et al. |
| 6,942,206 | B2 | 9/2005 | Kuwata et al. |
| 6,973,285 | B2 | 12/2005 | Sekiyama et al. |
| 6,988,730 | B2 | 1/2006 | Fukatsu et al. |
| 6,997,456 | B2 | 2/2006 | Fukatsu et al. |
| 7,341,248 | B2 | 3/2008 | Kuwata et al. |
| 7,448,615 | B2 | 11/2008 | Takamura |

FOREIGN PATENT DOCUMENTS

| | | |
|---|---|---|
| JP | 2005-263488 | 9/2005 |
| JP | 2006-306530 | 11/2006 |

*Primary Examiner* — Stefanos Karmis
*Assistant Examiner* — Luis A Gonzalez
(74) *Attorney, Agent, or Firm* — Fitzpatrick, Cella, Harper & Scinto

(57) ABSTRACT

A sheet processing apparatus includes an intermediate stacking portion which temporarily stacks, thereon, a sheet conveyed thereto; a discharge portion which discharges sheet stacked on the intermediate stacking portion; an aligning member which is provided downstream of the discharge portion in a sheet conveying direction and has a sheet holding surface capable of holding the lower surfaces of the sheet and a sheet aligning surface capable of abutting against end portions of the sheet in the widthwise direction orthogonal to the sheet conveying direction, the aligning member being movable in the widthwise direction; a first stacking portion which is provided below the aligning member and stacks, thereon, a sheet discharged from the discharge portion; and a second stacking portion which is provided above the aligning member and stacks, thereon, a sheet conveyed thereto; wherein a standby position of the aligning member is at a position more inward than the outermost position in the widthwise direction, within the range through which the aligning member is movable.

15 Claims, 11 Drawing Sheets

SHEET PROCESSING APPARATUS AND IMAGE FORMING APPARATUS INCLUDING THE SAME

This is a divisional of U.S. patent application Ser. No. 12/017,792, filed Jan. 22, 2008, allowed Sep. 17, 2010.

BACKGROUND OF THE INVENTION

1. Field of the Invention

The present invention relates to a sheet processing apparatus capable of selectively performing processing to sheets received from the main body of an image forming apparatus.

2. Description of the Related Art

Conventionally, among image forming apparatuses such as copying machines and printers, there have been image forming apparatuses including sheet processing apparatuses capable of successively receiving sheets on which images have been formed and selectively performing, on the sheets, processing such as binding. For example, Japanese Patent Application Laid-Open No. 2005-263488 discloses a sheet processing apparatus which is structured such that sheets are discharged to and stacked on an intermediate stacking portion through an intermediate roller, then are aligned at their end portions on the intermediate stacking portion and, then, are subjected to binding processing through a binding device, such as a stapler. Then, joggers for aligning the end portions of the sheets, which are constituents of the intermediate portion, are evacuated to positions having, therebetween, a width greater than the sheet width, and the sheets which have been subjected to the binding processing through the stapler are stacked on a stack tray under the intermediate stacking portion.

Further, there are sheet processing devices including plural trays, in order to sort sheets according to the applications, in addition to binding functions such as staplers. For example, if plural trays as aforementioned are provided in the aforementioned sheet processing apparatus at an upper portion thereof, this will increase the size of the entire apparatus. However, by placing the aforementioned plural trays near the upper portions of the joggers, it is possible to structure the entire apparatus to have a reduced size.

However, in the case of structuring the apparatus as described above, when the joggers are evacuated to the outermost positions within the range through which the joggers are movable, there is induced the problem that the joggers interfere with removal of sheets stacked on the tray just above the joggers, thereby making it difficult to remove sheets.

Further, when the joggers are evacuated to the outermost positions within the range through which the joggers are movable, as described above, there is induced the problem of degradation of the viewability of sheets stacked on the tray under the joggers in a vertical direction.

SUMMARY OF THE INVENTION

The present invention provides a sheet processing apparatus which increases the viewability of sheets and makes it easier to remove sheets, while having trays for sorting sheets which are provided above joggers in a vertical direction for reducing the size of the apparatus.

In order to attain the aforementioned object, a sheet processing apparatus according to the present invention includes an aligning member which aligns a conveyed sheet and is movable in a widthwise direction orthogonal to a sheet conveying direction to align the conveyed sheet in the widthwise direction; and a stacking portion which is provided below a position of the conveyed sheet to be aligned by the aligning member and stacks the aligned sheet, wherein the aligning member can move more outwardly than an end portion of the stacking portion in the widthwise direction, and wherein a standby position of the aligning member, where the aligning member is on standby without operating, is at a position more inwardly by a predetermined amount than the outermost position in the widthwise direction, within the range through which the aligning member is movable.

The present invention also provides a sheet processing apparatus includes an aligning member which aligns a conveyed sheet and is movable in a widthwise direction orthogonal to a sheet conveying direction to align the conveyed sheet in the widthwise direction; and a stacking portion which is provided above a position of the conveyed sheet to be aligned by the aligning member and stacks, thereon, a sheet conveyed thereto, wherein the aligning member can move more outwardly than an end portion of the stacking portion in the widthwise direction, and wherein a standby position of the aligning member, where the aligning member is on standby without operating, is at a position more inwardly by a predetermined amount than the outermost position in the widthwise direction, within the range through which the aligning member is movable.

According to the present invention, it is possible to provide a sheet processing apparatus which increases the viewability of sheets stacked on the stacking portion below the aligning member and makes it easier to remove sheets from the stacking portion above the aligning member, while reducing the size of the entire sheet processing apparatus.

Further features of the present invention will become apparent from the following description of exemplary embodiments (with reference to the attached drawings).

DESCRIPTION OF THE EMBODIMENTS

Hereinafter, with reference to the drawings, preferred embodiments for carrying out the present invention will be exemplarily described in detail. However, the sizes, materials, shapes and relative positions of components described in the embodiments should be properly changed according to the structure of the apparatus to which the invention is applied and according to various conditions, and the scope of the present invention is not intended to be limited to the following embodiments.

First Embodiment

Figure 1A:
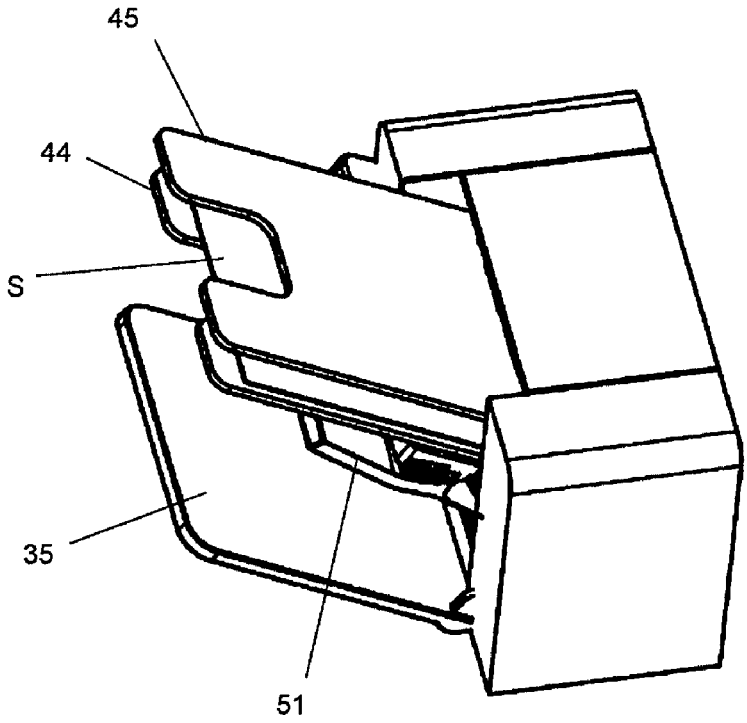
FIG. 1 is an external view of a sheet processing apparatus according to a first embodiment.
Figure 1B:
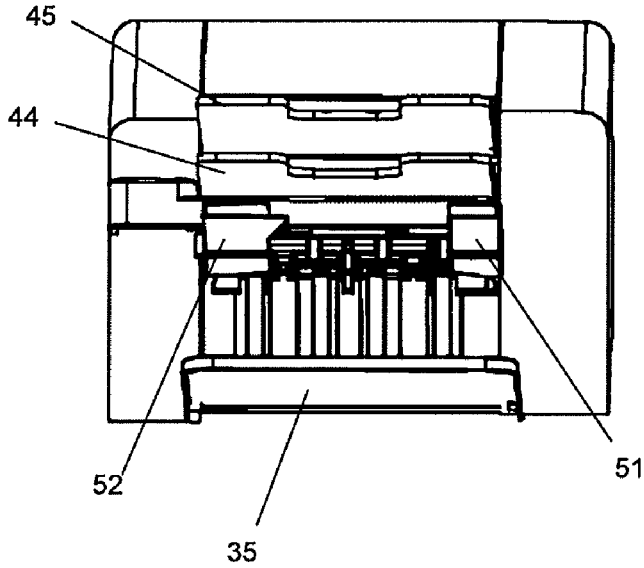
Figure 2:
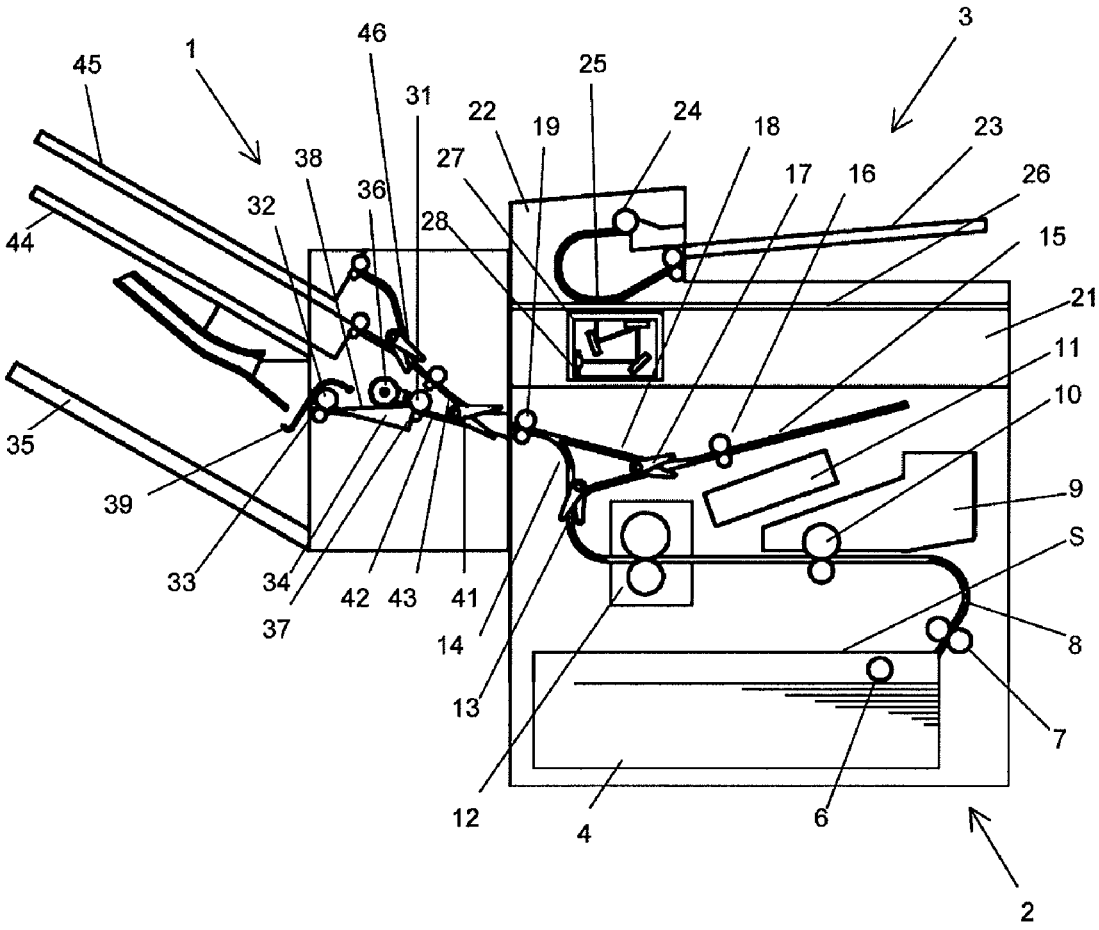
FIG. 2 is a schematic cross-sectional view of an image forming apparatus according to the first embodiment.

FIG. 1 is an external view of a sheet processing apparatus according to a first embodiment, and FIG. 2 is a schematic cross-sectional view illustrating an image forming apparatus connected to the sheet processing apparatus according to the first embodiment.

The sheet processing apparatus 1 according to the first embodiment is connected to the main body of the image forming apparatus as illustrated in FIG. 2 and selectively performs predetermined processing such as stapling on sheets on which images have been formed. Although there is exemplified, in this case, a stapler (binding unit) as a process unit which performs processing on the aforementioned sheets, the process unit is not limited thereto. For example, the process unit can be other process units, such as a punching unit which performs punching and a folding unit which performs folding, or appropriate combinations of these process units. The main body of the image forming apparatus includes an image forming portion 2 which forms images on sheets, and an image reading portion 3 which is connected to the image forming portion 2 and reads information written on originals.

As illustrated in FIG. 2, the image forming portion 2 separately feeds a plurality of sheets S stacked on a sheet cassette 4, one by one, through a feeding roller 6 and a separately-conveying roller 7 and conveys them to an image forming processing unit 9 through a conveying guide 8.

The image forming processing unit 9 forms images (toner images) through an electrophotographic system. More specifically, light is directed from a laser scanner 11 to a photosensitive drum 10 as an image bearing member to form an image, then the aforementioned image is developed through toner, and the toner image is transferred to a sheet S.

The sheet S to which the toner image has been transferred from the photosensitive drum 10 is conveyed to a fixing device 12 which applies heat and a pressure thereto to fix the image.

The sheet S on which the image has been fixed is conveyed to a face-up conveying path 14 or a switch-back conveying path 15 which turns sheets upside down, wherein the switching between the face-up conveying path 14 and the switch-back conveying path 15 is performed by a conveying-path switching flapper 13.

The sheet transferred to the switch-back conveying path 15 is conveyed by a switch-back convey roller 16 until the rear end of the sheet passes through a reversing flapper 17. Thereafter, the switch-back conveying roller 16 is reversed, so that the aforementioned sheet is conveyed at a state where it is turned upside down such that its end which has been placed at the rear side is placed at the tip-end side. At this time, the reversing flapper 17 is switched over, so that the sheet which has been turned is conveyed to a face-down conveying path 18.

The face-up conveying path 14 and the face-down conveying path 18 are merged with each other before a discharge roller 19. Sheets guided to the face-up conveying path 14 and sheets which have been conveyed from the switch-back conveying path 15 and passed through the face-down conveying path 18 are both discharged from the image forming portion 2 through the discharge roller 19.

The image reading portion 3 is constituted by a scanner portion 21 and an automatic document feeding portion (hereinafter, referred to as an ADF) 22, as illustrated in FIG. 2. The ADF 22 separately feeds plural originals stacked on a original stack tray 23, one by one, through a feeding roller 24 to cause them to pass through a original reading position 25 at which an optical carriage 27 in the scanner portion 21 stays. Further, the ADF 22 can be opened or closed rearwardly about a hinge (not illustrated) at the rear side of the apparatus and is opened and closed when an original is placed on a original-base-plate glass 26.

The scanner portion 21 includes the movable optical carriage 27 and reads information written on originals. In the scanner portion 21, the optical carriage 27 reads information written on the original placed on the original-base-plate glass 26 while scanning the original in a horizontal direction, and a CCD 28 performs photoelectric conversion on the read information. Further, during reading the original by the aforementioned ADF 22, the optical carriage 27 stays at the original reading position 25 and reads the information written on the original being conveyed, as described above.

Figure 3:
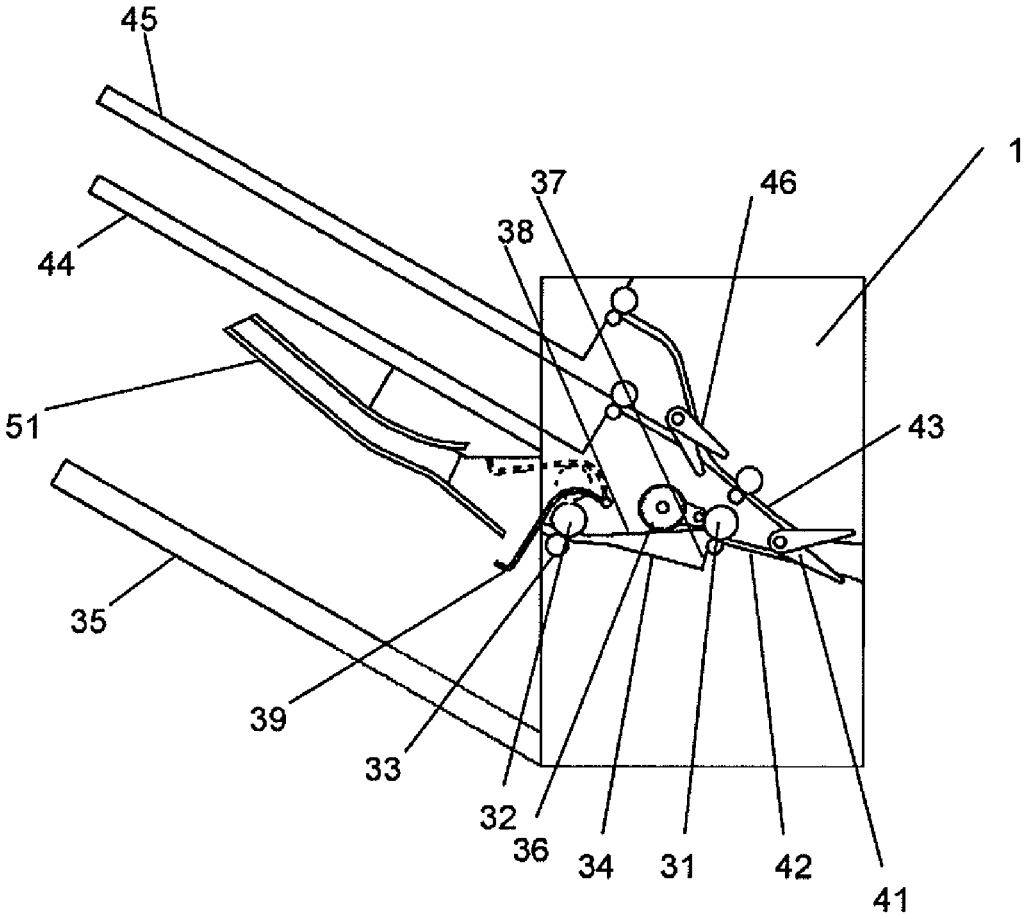
FIG. 3 is a schematic cross-sectional view of the sheet processing apparatus according to the first embodiment.

FIG. 3 is a schematic cross-sectional view for describing the structure of the sheet processing apparatus 1. The sheet processing apparatus 1, which is connected to a side surface of the main body of the image forming apparatus, receives sheets discharged from the image forming portion 2 through the discharge roller 19 and performs stapling processing thereon.

As illustrated in FIG. 3, the sheet processing apparatus 1 has an intermediate conveying roller 31. A discharge upper roller 32 and a discharge lower roller 33 constitute a discharge portion which discharges sheets which have been processed by a stapler (process unit) which will be described later. An intermediate stacking portion 34 temporarily stacks the aforementioned received sheets thereon. A first stack tray 35 as a first stacking portion stacks, thereon, sheets which have been subjected to stapling (aligning) processing and discharged through the discharge rollers 32 and 33 or sheets have been discharged therethrough without being subjected to stapling (aligning) processing. An aligning roller 36 performs aligning of the conveying direction of sheets stacked on the intermediate stacking portion 34. The aligning roller 36 is movable upwardly and downwardly with respect to the sheet stacking surface of the intermediate stacking portion 34. When the aligning roller 36 is descended, it abuts against the surface of the sheets on the intermediate stacking portion 34 and moves the sheets and, when the aligning roller 36 is ascended, it is evacuated to a position at which it does not interfere with the conveying of sheets to the intermediate stacking portion 34. The sheet processing apparatus 1 further has a first aligning reference wall in the sheet conveying direction and a conveying guide 38 above the intermediate stacking portion 34. Downstream of the discharge rollers 32 and 33, there is provided a stack-height detection flag 39 which abuts against the upper surface of the sheets stacked on the first stack tray 35 and detects the height of the stack. The discharge upper roller 32 can be spaced apart from the discharge lower roller 33 until it reaches the position designated by the broken line. When the rollers are spaced apart from each other, the stack-height detection flag 39 can be moved to the position designated by the broken line by being pushed upwardly by the roller 32.

The sheet processing apparatus 1 has a second stacking portion which stacks the aforementioned received sheets thereon, in addition to the aforementioned first stacking portion. In this case, the sheet processing apparatus 1 has a second stack tray 44 and a third stack tray 45 which enables sorting the aforementioned sheets thereinto and stacking the sheets thereon, as the second stacking portion. The stack trays 44 and 45 are provided above an aligning member, in a vertical direction, which will be described later. A switching member 41 is provided at the inlet of the apparatus for conveying sheets to the upper stack trays 44 and 45. By switching over the orientation of the switching member 41, the sheets fed to the sheet processing apparatus 1 are fed to a stapling conveying path 42 or a sorting conveying path 43. Then, the conveying path is switched over through a sorting member 46 which is provided in the sorting conveying path 43, and the sheets are discharged to and stacked on the second stack tray 44 or the third stack tray 45 as the upper stack tray, through the corresponding discharge roller.

Figure 4:
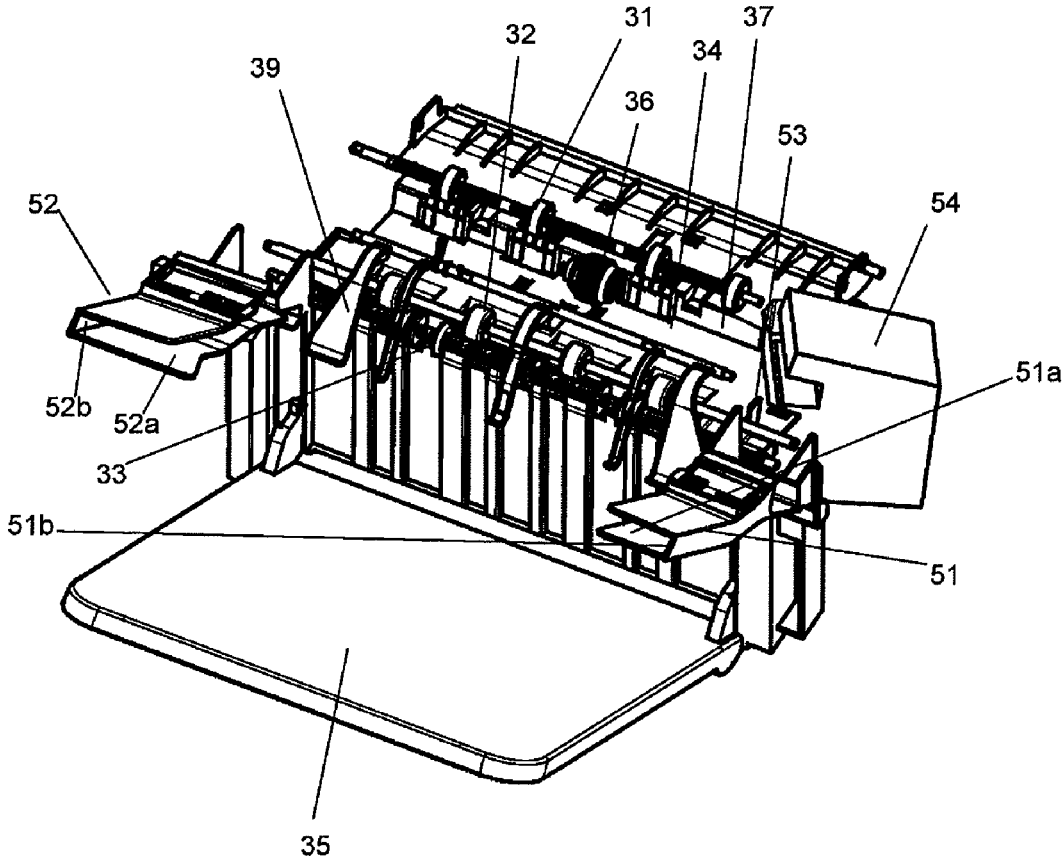
FIG. 4 is a perspective view of a sheet aligning portion according to the first embodiment.

FIG. 4 is a perspective view illustrating the intermediate stacking portion 34, at the downstream side in the sheet conveying direction. A reference-side jogger 51 and an aligning-side jogger 52, which is an aligning member that performs aligning operation in the widthwise direction orthogonal to the sheet conveying direction, are also illustrated in FIG. 4. The joggers 51 and 52 have sheet holding surfaces 51*a* and 52*a* capable of holding the lower surfaces of sheets and sheet aligning surfaces 51*b* and 52*b* capable of abutting against the end portions of the aforementioned sheets in the widthwise direction, respectively. The joggers 51 and 52 can be moved in the widthwise direction of sheets for aligning sheets in the widthwise direction and constitute the aligning portion in cooperation with a driving portion which will be described later. Further, the aforementioned first stack tray 35 is provided under the joggers 51 and 52, while the aforementioned second and third stack trays 44 and 45 are provided thereabove in the vertical direction (see FIG. 3). There is a second aligning reference wall 53 in the widthwise direction orthogonal to the sheet conveying direction. A stapler 54 binds the bundle of sheets which have been aligned.

Figure 5A:
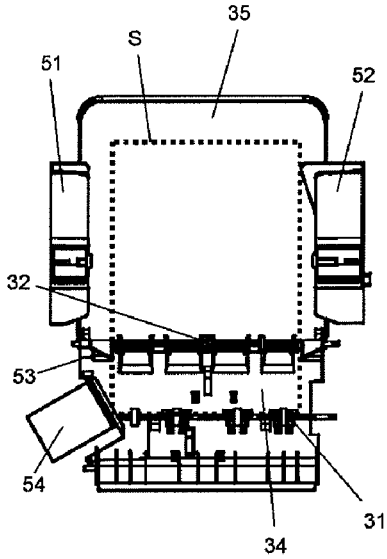
FIG. 5 is a top view of the sheet aligning portion according to the first embodiment.
Figure 5B:
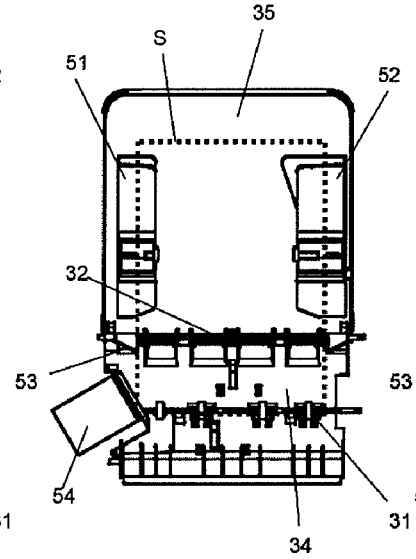
Figure 5C:
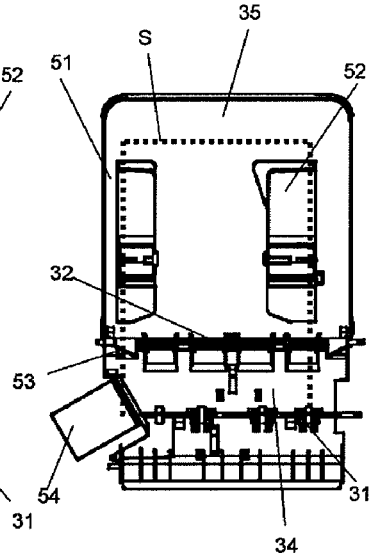

The aforementioned reference-side jogger 51 and the aligning-side jogger 52 exist downstream of the discharge rollers 32 and 33 in the sheet conveying direction and are shaped to form substantially an angular-U shape in such a way as to support the upper and lower surfaces of sheets S. Further, the joggers 51 and 52 are structured to be moved among plural positions illustrated in FIG. 5, in the sheet-widthwise direction, by the driving portion. In this case, the joggers 51 and 52 are moved by the driving portion and the controlling portion, among evacuation positions illustrated in FIG. 5A, reception positions illustrated in FIG. 5B and alignment positions illustrated in FIG. 5C. The evacuation positions illustrated in FIG. 5A are positions at which the sheet holding surfaces 51*a* and 52*b* are evacuated outwardly from the sheet conveying path, and the sheet holding surfaces of the joggers exist outwardly from the width of sheets S, in order to enable discharging, to the stack tray 35, sheets which have been subjected to stapling processing. The reception positions illustrated in FIG. 5B are positions at which the sheet holding surfaces 51*a* and 52*b* support the lower surfaces of sheets S, and the sheet aligning surfaces 51*b* and 52*b* have, therebetween, a width greater by a predetermined amount than the width of sheets S for preventing the convey of sheets from being hindered, when the sheets S have been conveyed to the intermediate stacking portion 34. The alignments position illustrated in FIG. 5C are positions at which the sheet aligning surfaces 51*b* and 52*b* abut against the end portions of sheets S being held by the sheet holding surfaces 51*a* and 52*b* for aligning the sheets, and the sheets S have been moved until they abut against the second aligning reference wall 53 for aligning the sheets. In the present embodiment, the reference-side jogger 51 is stopped at the reception position illustrated in FIG. 5B by a stopper (not illustrated), when it has been moved to substantially the same position as that of the second aligning reference wall 53, as will be described later. Thereafter, only the aligning-side jogger 52 is moved to the alignment position illustrated in FIG. 5C. Namely, the reception position and the alignment position of the reference-side jogger 51 are the same position. It goes without saying that the reception position and the alignment position of the reference-side jogger 51 can be set to be different from each other.

The aforementioned joggers 51 and 52 are positioned at power-on or during standby between jobs at a home position which is set to be more inwardly by a predetermined amount than the outermost position (the evacuation position) within the range through which the joggers 51 and 52 are movable.

Figure 6:
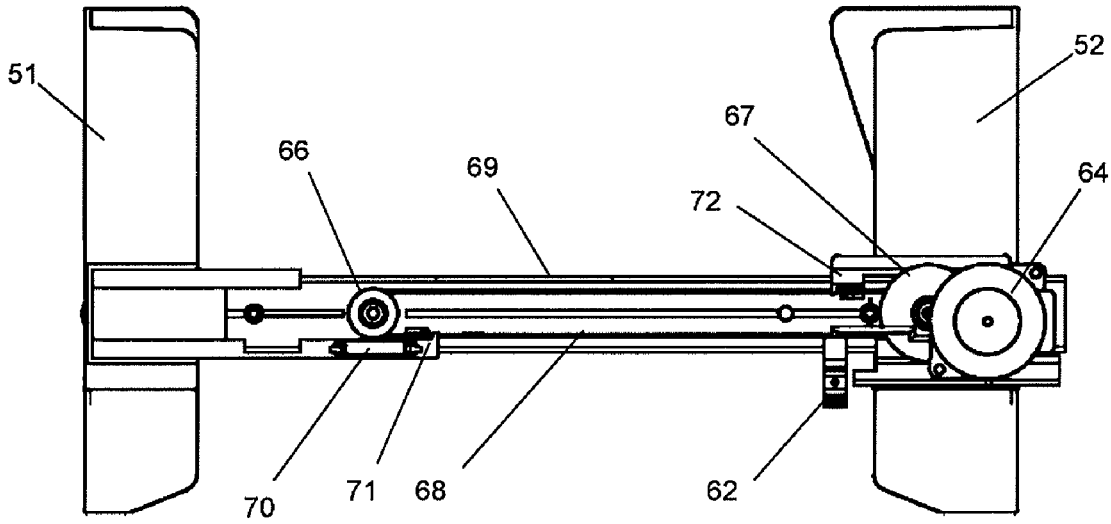
FIG. 6 is a top view of the sheet aligning portion according to the first embodiment.

FIG. 6 is a view illustrating the driving portion and the guide for the joggers 51 and 52. Referring to FIG. 6, a pulley 67, a pulley 66 and a timing belt 68 are driven by a jogger motor 64 as the driving portion. Sliders 71 and 72 are secured to the timing belts 68, the slider 72 and the aligning-side jogger 52 are secured to each other, and the slider 71 and the reference-side jogger 51 are coupled to each other through a spring 70. The joggers 51 and 52 can be moved in the widthwise direction of sheets (in the lateral direction in the figure) by being guided by the guide 69, and the positions of the joggers 51 and 52 are detected by a jogger-position sensor 62. The reference-side jogger 51 and the aligning-side jogger 52 are moved from the evacuation positions to the reception positions, in synchronization with each other, through the movement of the timing belt 68. The reference-side jogger 51 is stopped by the stopper (not illustrated), when it has been moved to substantially the same position as that of the second aligning reference wall 53. Thereafter, only the slider 71 is moved along with the aligning-side jogger 52 since the spring 70 is stretched, until the aligning-side jogger 52 reaches the alignment position. Accordingly, in this case, the reference-side jogger 51 exists at the same position as that of the second aligning reference wall 53, at the alignment position.

Figure 7:
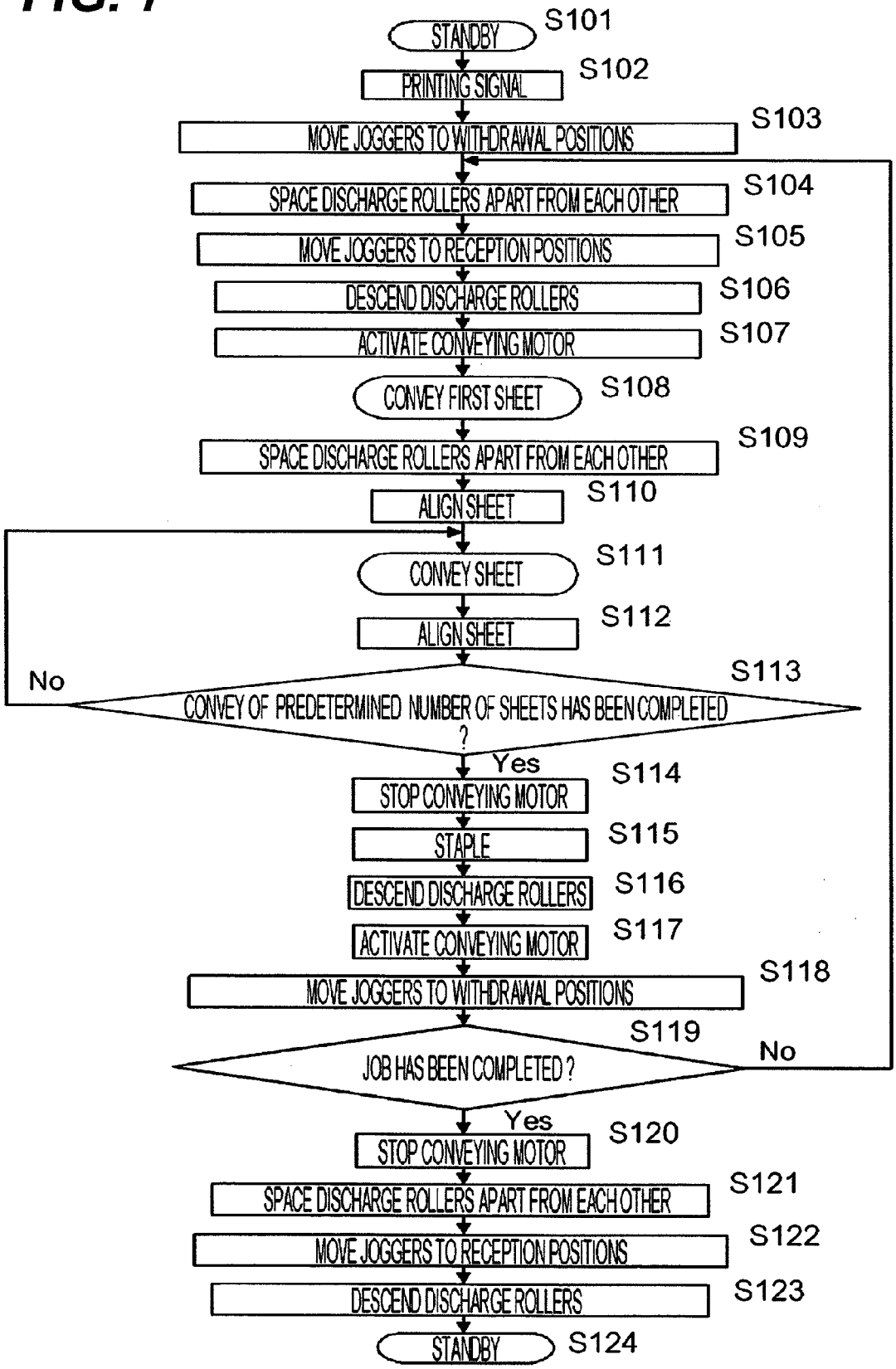
FIG. 7 is a flow chart of operations of the sheet processing apparatus according to the first embodiment.
Figure 8:
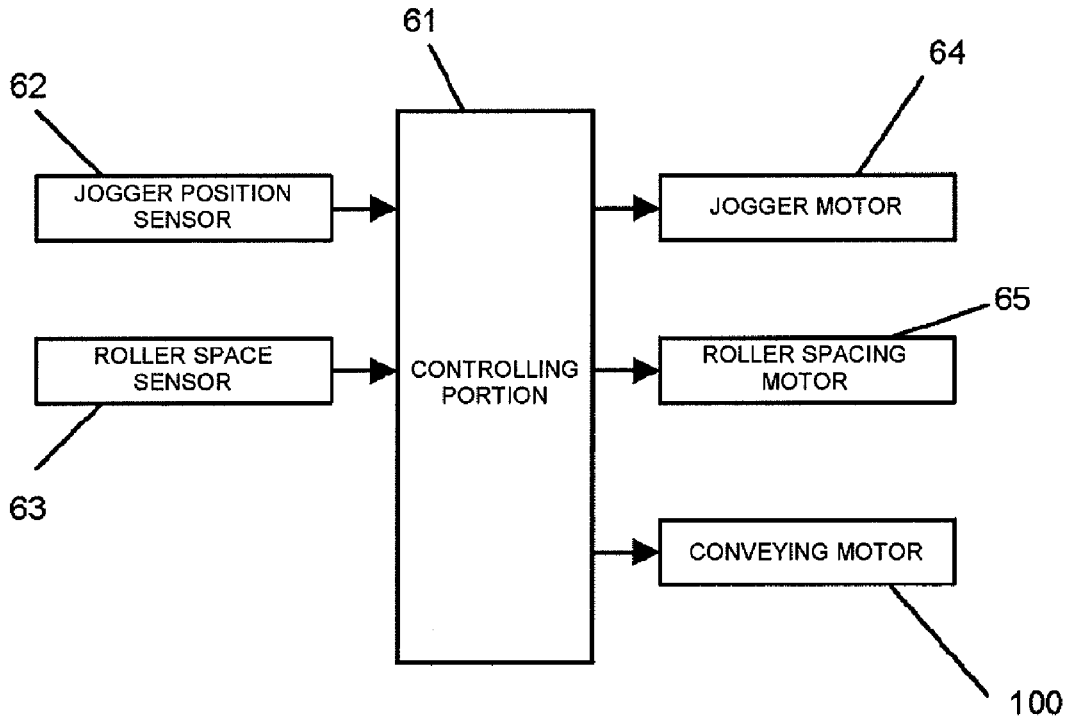
FIG. 8 is a block diagram of the sheet processing apparatus according to the first embodiment.

Next, with reference to FIG. 7 and FIG. 8, there will be described a sheet processing operation by the sheet processing apparatus 1.

During standby (S101), the home positions of the joggers 51 and 52 are set to the reception positions (FIG. 5B). If the sheet processing apparatus 1 receives a print signal (S102) from the image forming portion 2, the controlling portion 61 provided in the sheet processing apparatus 1 drives the jogger motor 64 to move the joggers 51 and 52 to the evacuation positions (FIG. 5A) on the basis of information from the jogger-position sensor 62 (S103). Next, the joggers 51 and 52 are to be moved to the reception positions (FIG. 5B), but if the joggers are moved to the reception positions at this state, they may impinge on the stack-height detection flag 39 depending on the position of the stack-height detection flag 39. Therefore, before operating the joggers 51 and 52, the controlling portion 61 drives a roller spacing motor 65 to move the discharge upper roller 32 to a spacing position on the basis of information from a roller space sensor 63 (S104) for ascending the stack-height detection flag 39. This causes the stack-height detection flag 39 to move to the inside of the substantially-angular-U shape formed by the joggers 51 and 52, which prevents the joggers 51 and 52 from impinging on the stack-height detection flag 39 even when the joggers 51 and 52 are moved. At this state, the joggers 51 and 52 are moved to the reception positions (S105) and, after the movement, the discharge upper roller 32 is temporarily restored to the conveying position from the spacing position (S106). However, the stack-height detection flag 39 is left within the substantially-angular-U shape by being supported by the lower surfaces of the joggers 51 and 52.

Before a sheet is conveyed to the inside of the sheet processing apparatus, a conveying motor 100 is activated (S107)

to rotate the conveying roller in the apparatus. When a sheet is conveyed to the sheet processing apparatus 1 (S108), the sheet is conveyed to the stapling conveying path 42 through the switching member 41 and then is discharged to the intermediate stacking portion 34 through the intermediate conveying roller 31. The first sheet to be processed is certainly conveyed toward the substantially-angular-U shape formed by the joggers 51 and 52, since the discharge upper roller 32 is positioned at the convey position. After the tip end of the first sheet is conveyed to the joggers 51 and 52, the discharge upper roller 32 is moved to the spacing position (S109) so that it is evacuated, which prevents the sheet from being further conveyed after the rear end of the sheet is passed through the intermediate conveying roller 31 and also prevents the discharge upper roller 32 from interfering with the movement of the sheet caused by subsequent aligning operations. Accordingly, until the completion of aligning of a predetermined number of sheets to be processed, after the first sheet, the discharge upper roller 32 is held at the spacing position.

Sheets are aligned one by one (S110) and, when a sheet is stacked on the intermediate stacking portion 34, the sheet is aligned in the widthwise direction through the movement of the joggers 51 and 52. At this time, the reference-side jogger 51 is fixed at the position at which the sheet aligning surface 51*b* is flashed with the second aligning reference wall 53. Then, the aligning-side jogger 52 is moved, in the direction orthogonal to the sheet conveying direction, to the alignment position (FIG. 5C) at which the sheet abuts against the second aligning reference wall 53 for aligning the sheet in the widthwise direction.

Next, the aligning roller 36 is descended to abut against the surface of the sheet and then is rotated in the direction opposite from the sheet conveying direction to move the sheet until it abuts against the first aligning reference wall 37, thereby aligning the sheet in the sheet conveying direction.

A second sheet is conveyed (S111) and aligned (S112) with the discharge upper roller 32 held at the spacing position, as described above.

The same operations as the aforementioned operations are repeatedly performed until the predetermined number of sheets to be stapled is reached (S113). After the completion of aligning of the last sheet, the conveying motor 100 is stopped (S114), and the stapler 54 is driven to bind the bundle of the aforementioned sheets which have been aligned (S115). Thereafter, the discharge upper roller 32 is moved to the conveying position (S116), then the conveying motor 100 is activated (S117) to convey the aforementioned bundle of sheets and, further, the joggers 51 and 52 are evacuated to the evacuation positions (FIG. 5A) at which their lower surfaces have, therebetween, a width greater than the width of the sheets (S118). Thus, the bundle of sheets is dropped to and staked on the stack tray 35. Although, in the present embodiment, there has been described the structure of the sheet processing apparatus 1 which is provided with the controlling portion 61, the controlling portion 61 can be provided integrally with a controlling portion (not illustrated) provided in the main body of the image forming apparatus for controlling the entire image forming apparatus, such that the controlling portion 61 directly controls the sheet processing apparatus 1 from the main body of the image forming apparatus.

Hereinafter, there will be described the operations which are performed by the apparatus, after a job which has been subjected to stapling processing is discharged to the stack tray 35.

Figure 9A:
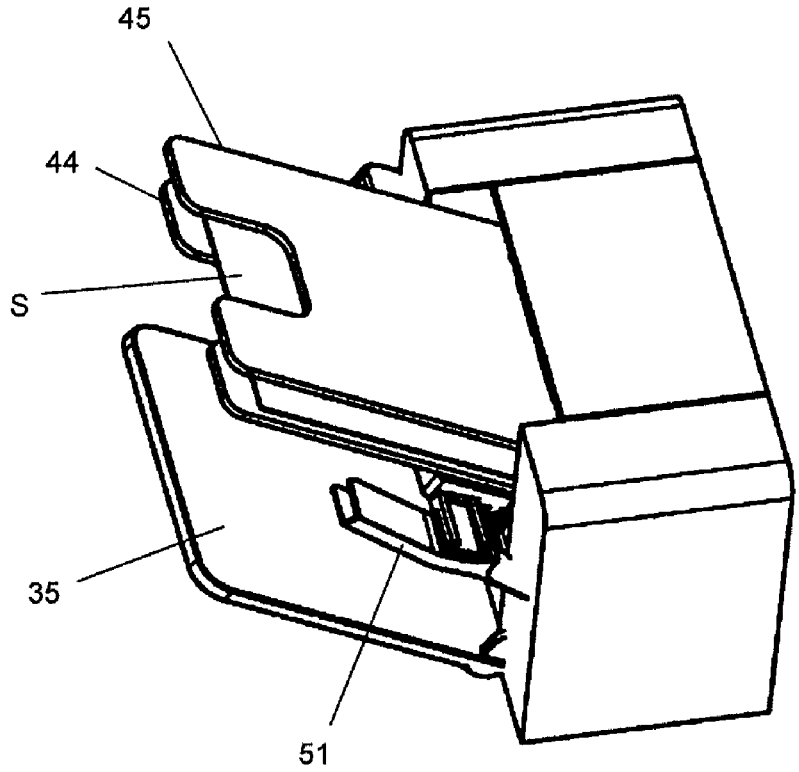
FIG. 9 is an external view of a sheet processing apparatus according to a second embodiment.
Figure 9B:
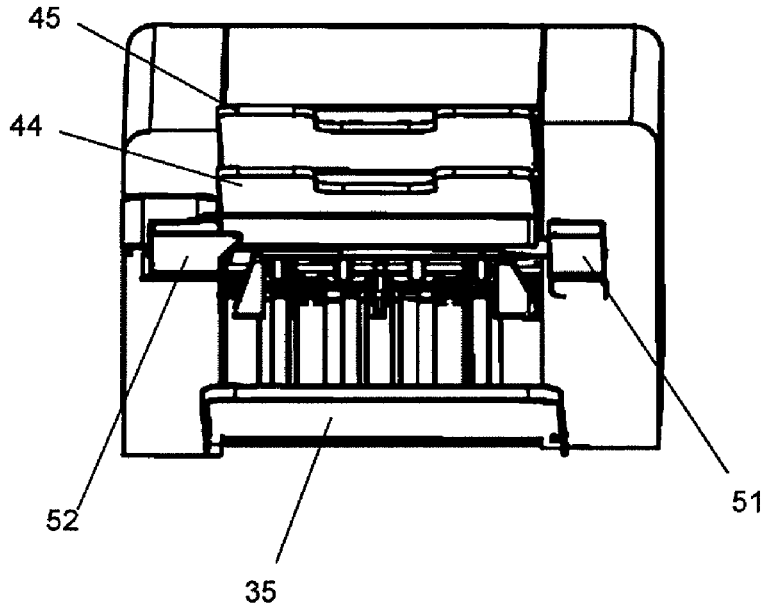

The upper stack trays 44 and 45 have a width (a length in the sheet-widthwise direction) set to enable stacking a sufficient number of sheets thereon, and are positioned at subsequently the same positions as the positions of the joggers 51 and 52 at the reception positions (FIG. 5B). The reception positions of the joggers are set to positions which have, therebetween, a width greater by a predetermined amount than the width of sheets. This is because a tray having the same width as that between the reception positions of the joggers enables stacking a sufficient number of sheets thereon. The width of the trays is set to be a smallest possible value as described above, which improves the viewability of sheets stacked on the first stack tray 35, makes it easier to remove sheets stacked on the second stack tray 44 and enables reduction of the size of the apparatus. However, the second stack tray 44 is installed near and right above the joggers 51 and 52 in the vertical direction. Therefore, when the joggers 51 and 52 exist at the outermost evacuation positions (FIG. 5A), the joggers are largely protruded from an end of the second stack tray 44 in the sheet-widthwise direction as illustrated in FIG. 9, which causes the reference-side jogger 51 to interfere with the removal of sheets from the second stack tray at its front side.

In cases where processing of a next job is successively performed after the completion of the aforementioned job, the same sequence as the aforementioned sequence is repeatedly performed (S119). Further, in cases where the job is completed at this time, the conveying motor is stopped (S120), and the joggers 51 and 52 are moved to the reception positions (FIG. 5B) as the home positions. Accordingly, the reference-side jogger 51 is positioned at substantially the same position as an end portion of the second stack tray 44. This prevents the reference-side jogger 51 from interfering with the removal of the sheets stacked on the second stack tray 44 as illustrated in FIG. 1, thereby making it easier to remove the sheets. Further, at the reception position, the reference-side jogger 51 is substantially hidden under the second stack tray 44, thereby making it easier to check the sheets stacked on the first stack tray 35. Although, in this example, there is exemplified a case where the jogger 51 is positioned at the same position as that of an end portion of the second stack tray 44 at the home position, the present invention is not limited thereto, and the jogger 51 can be positioned more inwardly than the end portion of the second stack tray 44, for example. Similarly to a description above, when the jogger 51, at the home position, is positioned at the same position as that of an end portion of the first stack tray 35, or at more inwardly than the end portion of the first stack tray 35, thereby making it easier to check the sheets stacked on the first stack tray 35.

When the joggers 51 and 52 are moved to the reception position, similarly to when the first job is processed, the discharge upper roller 32 is spaced apart from the discharge lower roller (S121) to ascend the stack-height detection flag 39 and, thereafter, the joggers 51 and 52 are moved to the reception positions (S122). Then, the discharge roller is descended (S123) and is restored to a standby state (S124).

As described above, in the present embodiment, the home positions of the joggers 51 and 52 is set to positions more inwardly by a predetermined amount than the evacuation positions which are the outermost positions within the range through which the joggers 51 and 52 are movable. This can provide a sheet processing apparatus capable of improving the viewability of sheets stacked on the first stack tray 35 and making it easier to remove sheets from the second stack tray 44, while reducing the size of the entire sheet processing apparatus.

Further, the home positions of the joggers 51 and 52 are set to the reception positions thereof, which improves the viewability of the first stack tray 35 and makes it easier to access the second stack tray 44, in comparison with cases where the home positions are set to the evacuation positions as in FIG. 9.

Further, in this case, the joggers 51 and 52 are moved in conjunction with each other and, accordingly, the aligning-side jogger 52 exists at the home position when the reference-side jogger 51 has been moved to the home position. However, in the case where the sheet processing apparatus is connected to a side surface of the main body of the image forming apparatus and is structured to allow sheets stacked on the trays to be removed only at the front side or the side surface as the aforementioned sheet processing apparatus, the aligning-side jogger 52 which is positioned in the rear side of the apparatus does not affect the accessibility of sheets when sheets are removed, even when the aligning-side jogger 52 exists at the outermost evacuation position. Therefore, in this case, it is preferable to structure the apparatus such that only the reference-side jogger 51 positioned in the sheet-removal side is moved to the home position (the reception position) which is more inwardly by a predetermined amount than the evacuation position, in order to prevent the removal of sheets from being hindered.

Second Embodiment

Figure 10A:
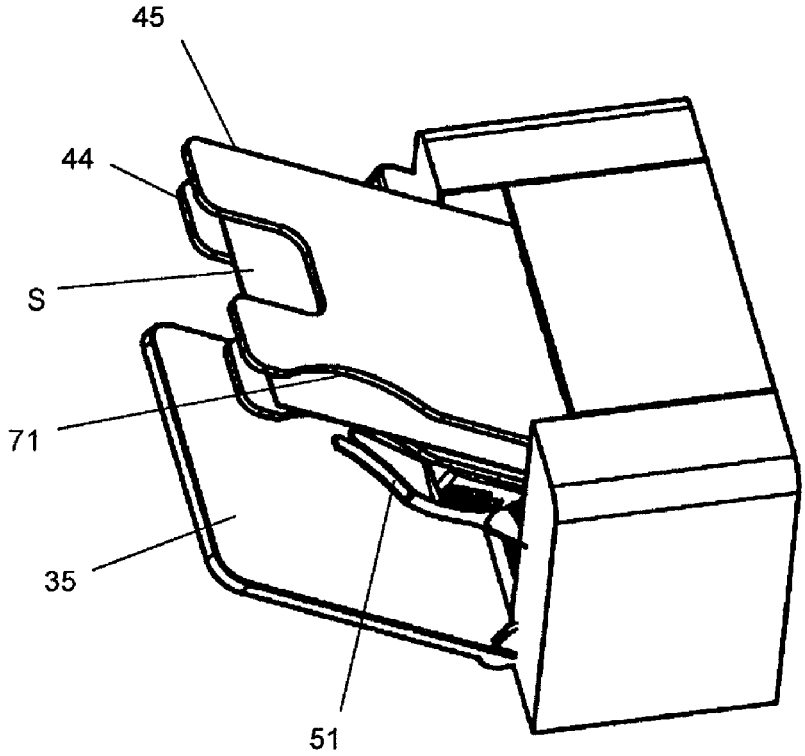
FIG. 10 is an external view of the sheet processing apparatus according to the second embodiment.
Figure 10B:
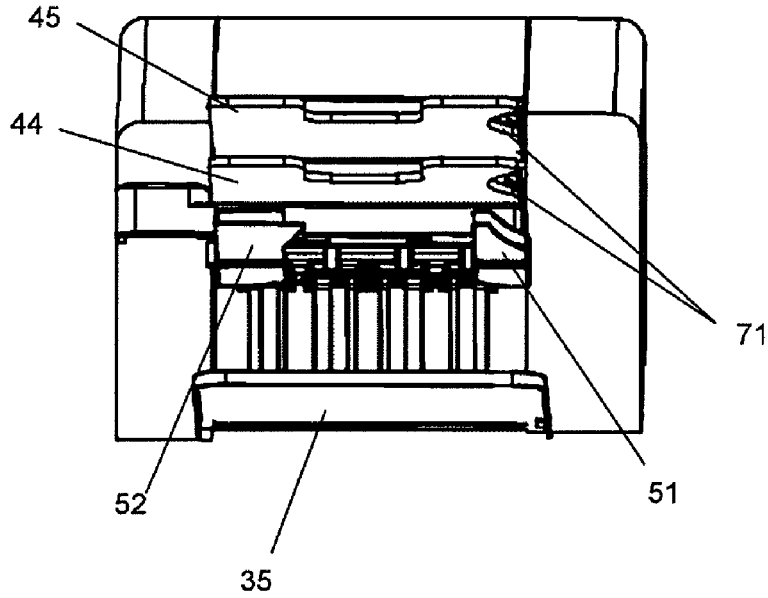

FIG. 10 is an external view illustrating a sheet processing apparatus according to a second embodiment.

As in FIG. 10A, in the present embodiment, there are provided upper stack trays 44 and 45 having stacking surfaces which are provided with cutout portions 71 at their sides which are accessed when sheets stacked thereon are removed. This makes it easier to remove sheets on these trays by grasping the end portions of the sheets. Further, a reference-side jogger 51, which is provided near the cutout portions of the aforementioned trays, is formed to have a shape which conforms to the aforementioned cutout portions 71, which prevents it from blocking the cutout portion 71 of the stack tray 44 at a home position illustrated in FIG. 10. In this case, as in FIG. 10A, the reference-side jogger 51 has no sheet aligning surface 51*b* and has only upper and lower surfaces at its downstream side, so that the end surfaces of sheets abut against the aligning surface 51*b* at its upstream side, while the lower surfaces of the sheets are supported by the sheet holding surface 51*a* from the upstream side to the downstream side thereof. This enables aligning similarly to in the aforementioned first embodiment. This can make it easier to access the sheets stacked on the stack tray 44.

Third Embodiment

FIG. 11 is a perspective view illustrating a sheet processing apparatus according to a third embodiment.

Figure 11A:
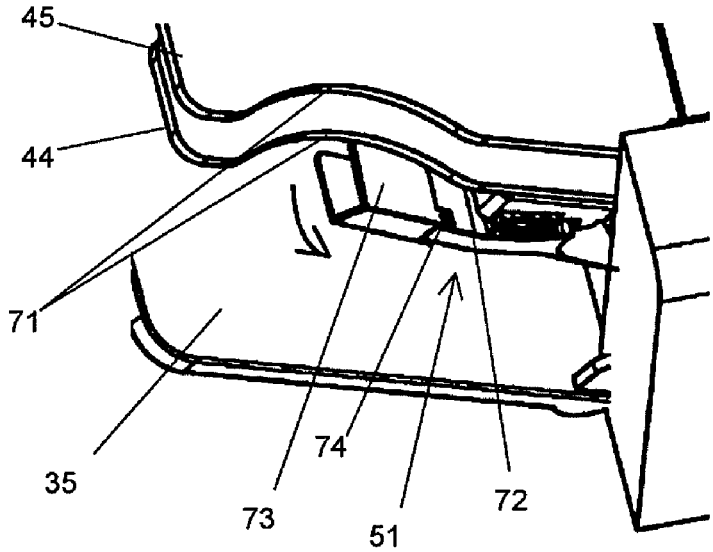
FIG. 11 is a perspective view of a sheet processing apparatus according to a third embodiment.
Figure 11B:
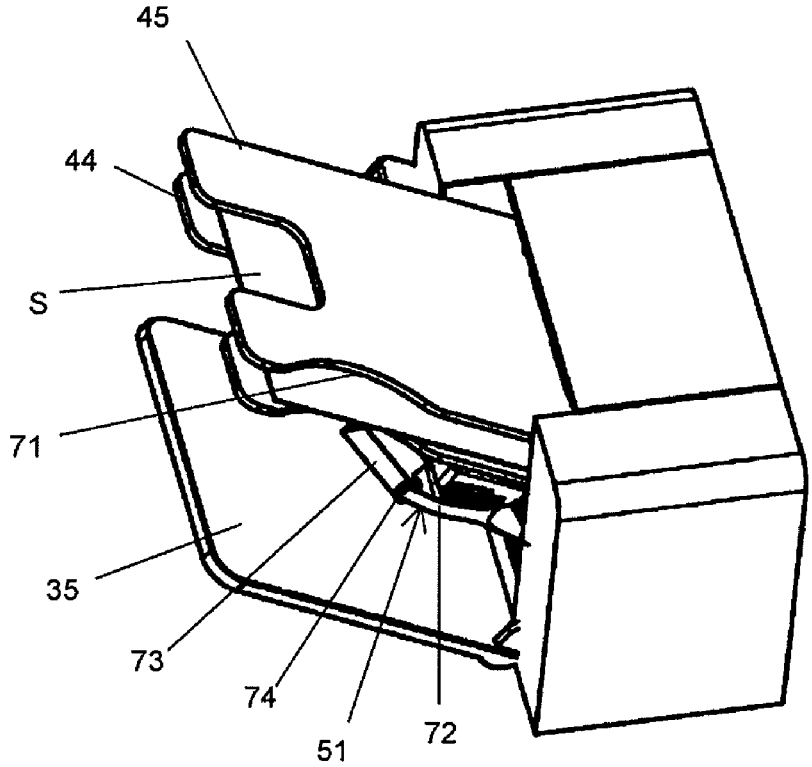

As in FIG. 11, in the present embodiment, there is provided, at the sheet-removal side, a reference-side jogger 51 constituted by a moving portion 72 movable in the sheet-widthwise direction, and a rotating portion 73 which is movable along with the aforementioned moving portion 72 and rotatable with respect to the aforementioned moving portion 72. The rotating portion 73 is structured such that it can be rotated about a supporting point 74 with respect to the moving portion 72 in the direction in which sheets stacked on the aforementioned jogger 51 are accessed. Further, the rotating portion 73 is biased through a spring (not illustrated) in the direction of an arrow illustrated in FIG. 11A.

In the present embodiment, similarly to in the aforementioned second embodiment, there are provided stack trays 44 and 45 having stacking surfaces which are provided with cutout portions 71 at their sheet-removal sides. When the reference-side jogger 51 exists at a home position as in FIG. 11A, the rotating portion 73 in the reference-side jogger 51 is exposed through the cutout portions 71. However, since the rotating portion 73 can be rotated with respect to the moving portion 72, the rotating portion 73 can be rotated inwardly as in FIG. 11B when sheets are removed, which enables certainly grasping the sheets S. This can make it easier to access to the sheets stacked on the second stack tray 44. Similarly to a description above, this can make it easier to check sheets stacked on the first stack tray 35.

Other Embodiments

Although, in the aforementioned embodiments, there have been exemplified cases where the apparatus is structured such that the joggers at the opposite sides in the sheet-widthwise direction are moved with respect to the second aligning reference wall for aligning sheets in the widthwise direction, the present invention is not limited thereto. For example, even when the apparatus is structured such that both the joggers are moved with respect to a center portion in the sheet-widthwise direction served, the present invention is effective. Further, there have been exemplified structures provided with joggers for aligning sheets in the widthwise direction at the opposite sides in the widthwise direction, the present invention is not limited thereto. For example, in cases where aligning is performed with respect to a single side in the sheet-widthwise direction, the apparatus can be structured such that the aforementioned jogger can be provided only at the other side in the widthwise direction, and the present invention can be applied to this structure for offering the same effects.

Further, although, in the aforementioned embodiments, there have been exemplified two stack trays as a second stacking portion which is provided above the aforementioned aligning portion, the present invention is not limited thereto. It is necessary only to provide at least one stacking portion, and it is possible to provide a single stacking portion or three or more stacking portions.

Further, although, in the aforementioned embodiments, there has been exemplified a copying machine as an image forming apparatus, the present invention is not limited thereto, and it is possible to employ other image forming apparatuses, such as a scanner, a printer or a facsimile. Also, it is possible to employ other image forming apparatuses, such as a compound machine having combined functions of these image forming apparatuses. The present invention can be applied to a sheet processing apparatus used with such an image forming apparatus for offering the same effects.

Further, although, in the aforementioned embodiments, there has been exemplified a sheet processing apparatus which is detachably connected to an image forming apparatus, the present invention is not limited thereto. For example, it is possible to employ a sheet processing apparatus including an image forming apparatus formed integrally therewith, and the present invention can be applied to such a sheet processing apparatus for offering the same effects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-015797, filed Jan. 26, 2007, No. 2008-008739, filed Jan. 18, 2008 which are hereby incorporated by reference herein in their entirety.

What is claimed is:

1. A sheet processing apparatus which processes a sheet conveyed from an image forming apparatus, the sheet processing apparatus comprising:

an aligning member which is movable in a widthwise direction orthogonal to a sheet conveying direction to align the conveyed sheet in the widthwise direction, and is movable more outwardly than an end portion of the stacking portion in the widthwise direction;

a stacking portion which is provided below a position of the conveyed sheet to be aligned by the aligning member and on which the aligned sheet is stacked; and a controller which controls the aligning member so that a standby position of the aligning member, where the aligning member is on standby when said sheet processing apparatus is at power-on or between jobs, is at a position more inwardly by a predetermined amount than the outermost position in the widthwise direction, within the range through which the aligning member is movable, and so that the aligning member moves from the standby position to the outermost position when the controller receives a print signal from the image forming apparatus, and then moves inwardly from the outermost position to receive the conveyed sheet.

2. The sheet processing apparatus according to claim 1, wherein a pair of the aligning members are provided at the opposite sides in the widthwise direction, and the standby position of at least the aligning member at the side, through which a sheet stacked on the stacking portion is removed, is at a position more inwardly by a predetermined amount than the outermost position in the widthwise direction, within the range through which the aligning member is movable.

3. The sheet processing apparatus according to claim 2, wherein the aligning member at the side, through which a sheet stacked on the stacking portion is removed, comprises a moving portion movable in the widthwise direction, and a rotating portion which is movable along with the moving portion and is rotatable with respect to the moving portion in the direction in which the sheet stacked on the stacking portion is accessed.

4. The sheet processing apparatus according to claim 1, wherein the aligning member can be moved to a evacuation position at which the sheet holding surface is evacuated more outwardly than the width of the sheet, a reception position at which the sheet aligning surface does not abut against end portions of a conveyed sheet in the widthwise direction and the sheet holding surface holds the lower surfaces of the sheet, and an alignment position at which the sheet aligning surface abuts against end portions of the sheet held by the sheet holding surface in the widthwise direction for aligning the sheet, and the standby position is set to the reception position.

5. The sheet processing apparatus according to claim 1, wherein the standby position of the aligning member is at the same position as that of an end portion of the stacking portion in the widthwise direction or at a position more inwardly than an end portion of the stacking portion in the widthwise direction.

6. The sheet processing apparatus according to claim 1, further comprising:

an intermediate stacking portion which stacks a sheet conveyed thereto;

wherein the aligning member aligns a sheet stacked on the intermediate stacking portion.

7. A sheet processing apparatus which processes a sheet conveyed from an image forming apparatus, the sheet processing apparatus comprising:

an aligning member which is movable in a widthwise direction orthogonal to a sheet conveying direction to align the conveyed sheet in the widthwise direction, and is movable more outwardly than an end portion of the stacking portion in the widthwise direction;

a stacking portion which is provided above a position of the conveyed sheet to be aligned by the aligning member and on which a sheet conveyed thereto is stacked; and a controller which controls the aligning member so that a standby position of the aligning member, where the aligning member is on standby when said sheet processing apparatus is at power-on or between jobs, is at a position more inwardly by a predetermined amount than the outermost position in the widthwise direction, within the range through which the aligning member is movable and so that the aligning member moves from the standby position to the outermost position when the controller receives a print signal from the image forming apparatus, and then moves inwardly from the outermost position to receive the conveyed sheet.

8. The sheet processing apparatus according to claim 7, wherein a pair of the aligning members are provided at the opposite sides in the widthwise direction, and the standby position of at least the aligning member at the side, through which a sheet stacked on the stacking portion is removed, is at a position more inwardly than the outermost position in the widthwise direction, within the range through which the aligning member is movable.

9. The sheet processing apparatus according to claim 8, wherein the aligning member at the side, through which a sheet stacked on the stacking portion is removed, comprises a moving portion movable in the widthwise direction, and a rotating portion which is movable along with the moving portion and is rotatable with respect to the moving portion in the direction in which the sheet stacked on the stacking portion is accessed.

10. The sheet processing apparatus according to claim 7, wherein the aligning member can be moved to a evacuation position at which the sheet holding surface is evacuated more outwardly than the width of a sheet, a reception position at which the sheet aligning surface does not abut against end portions of a conveyed sheet in the widthwise direction and the sheet holding surface holds the lower surfaces of the sheet, and an alignment position at which the sheet aligning surface abuts against end portions of the sheet held by the sheet holding surface in the widthwise direction for aligning the sheet, and the standby position is set to the reception position.

11. The sheet processing apparatus according to claim 7, wherein the standby position of the aligning member is at the same position as that of an end portion of the stacking portion in the widthwise direction or at a position more inwardly than an end portion of the stacking portion in the widthwise direction.

12. The sheet processing apparatus according to claim 7, wherein the staking portion has a stacking surface having a cutout portion at a portion thereof at its side, through which a sheet stacked thereon is removed, and the aligning member is formed to have a shape which conforms to the cutout portion.

13. The sheet processing apparatus according to claim 7, further comprising:

an intermediate stacking portion which stacks a sheet conveyed thereto;

wherein the aligning member aligns a sheet stacked on the intermediate stacking portion.

14. An image forming apparatus comprising an image forming portion which forms an image on a sheet and a sheet processing apparatus capable of selectively performing processing on a sheet conveyed from the image forming apparatus, wherein the sheet processing apparatus comprising:

an aligning member which is movable in a widthwise direction orthogonal to a sheet conveying direction to align the conveyed sheet in the widthwise direction, and is movable more outwardly than an end portion of the stacking portion in the widthwise direction;

a stacking portion which is provided below a position of the conveyed sheet to be aligned by the aligning member and on which the aligned sheet is stacked; and a controller which controls the aligning member so that a standby position of the aligning member, where the aligning member is on standby when said sheet processing apparatus is at power-on or between jobs, is at a position more inwardly by a predetermined amount than the outermost position in the widthwise direction, within the range through which the aligning member is movable and so that the aligning member moves from the standby position to the outermost position when the controller receives a print signal from the image forming apparatus, and then moves inwardly from the outermost position to receive the conveyed sheet.

15. An image forming apparatus comprising an image forming portion which forms an image on a sheet and a sheet processing apparatus capable of selectively performing processing on a sheet conveyed from the image forming apparatus, wherein the sheet processing apparatus comprising:

an aligning member which aligns a conveyed sheet and is movable in a widthwise direction orthogonal to a sheet conveying direction to align the conveyed sheet in the widthwise direction, and is movable more outwardly than an end portion of the stacking portion;

a stacking portion which is provided above a position of the conveyed sheet to be aligned by the aligning member and on which a sheet conveyed thereto is stacked; and a controller which controls the aligning member so that a standby position of the aligning member, where the aligning member is on standby when said sheet processing apparatus is at power-on or between jobs, is at a position more inwardly by a predetermined amount than the outermost position in the widthwise direction, within the range through which the aligning member is movable and so that the aligning member moves from the standby position to the outermost position when the controller receives a print signal from the image forming apparatus, and then moves inwardly from the outermost position to receive the conveyed sheet.

* * * * *